US009624914B2

(12) United States Patent
Maruoka et al.

(10) Patent No.: US 9,624,914 B2
(45) Date of Patent: Apr. 18, 2017

(54) HYDRAULIC PUMP

(71) Applicant: NABTESCO CORPORATION, Tokyo (JP)

(72) Inventors: Masahiko Maruoka, Gifu (JP); Atsushi Fukui, Gifu (JP)

(73) Assignee: NABTESCO CORPORATION, Tokyo (JP)

( * ) Notice: Subject to any disclaimer, the term of this patent is extended or adjusted under 35 U.S.C. 154(b) by 261 days.

(21) Appl. No.: 13/776,284

(22) Filed: Feb. 25, 2013

(65) Prior Publication Data

US 2013/0224044 A1 Aug. 29, 2013

(30) Foreign Application Priority Data

Feb. 28, 2012 (JP) ..... 2012-042266

(51) Int. Cl.
*F04B 1/12* (2006.01)
*F04B 1/20* (2006.01)
*F04B 1/32* (2006.01)

(52) U.S. Cl.
CPC ..... *F04B 1/20* (2013.01); *F04B 1/124* (2013.01); *F04B 1/2085* (2013.01); *F04B 1/324* (2013.01)

(58) Field of Classification Search
CPC ..... F04B 1/2078; F04B 1/2085
USPC ..... 417/269; 92/13, 71
See application file for complete search history.

(56) References Cited

U.S. PATENT DOCUMENTS 2,403,371 A 7/1946 Field et al.
3,266,434 A 8/1966 McAlvay
3,935,796 A 2/1976 Wood
4,252,051 A * 2/1981 Sato ..... F04B 1/126 91/499

(Continued)

FOREIGN PATENT DOCUMENTS

GB 646371 A 11/1950
GB 709183 A 5/1954

(Continued)

OTHER PUBLICATIONS

An Office Action; "Notification of Reason for Rejection," issued by the Japanese Patent Office on Aug. 14, 2015, which corresponds to Japanese Patent Application No. 2012-042266 and is related to U.S. Appl. No. 13/776,284; with English language translation.

(Continued)

*Primary Examiner* — Charles Freay
(74) *Attorney, Agent, or Firm* — Studebaker & Brackett PC

(57) ABSTRACT

A rotational shaft 22 receives input of torque that is output from an electric motor 19. A housing 23 rotatably supports the rotational shaft 22. A cylinder block 24 inside the housing 23 rotates with the rotational shaft 22. The pistons 25 are supported relative to the respective cylinder chambers 24*a* in the cylinder block 24 so as to be slidably displaceable. A swash plate 26 is provided so as to come into contact with ends of the pistons 25 and be rotatable around the rotational shaft 22 with the pistons 25, and be rotatable about a rotation centerline that is obliquely inclined relative to the rotational shaft 22. A case 27 inside the housing 23 is pivotably supported relative to the housing 23. A bearing portion 28 holds the swash plate 26 relative to the case 27 so as to be rotatable around the rotation centerline.

6 Claims, 5 Drawing Sheets

(56) References Cited

U.S. PATENT DOCUMENTS

| | | | | |
|---|---|---|---|---|
| 4,738,185 | A | 4/1988 | Kamimura | |
| 5,391,058 | A * | 2/1995 | Goto et al. | 417/223 |
| 6,036,374 | A * | 3/2000 | Fisher et al. | 384/621 |
| 6,287,086 | B1 * | 9/2001 | Steen | 417/269 |
| 6,694,729 | B1 * | 2/2004 | Trimble | 60/444 |
| 6,996,981 | B2 * | 2/2006 | Ito et al. | 60/487 |
| 2001/0054352 | A1 * | 12/2001 | Sugiura | F04B 27/0886 92/61 |
| 2005/0053478 | A1 * | 3/2005 | Sakikawa et al. | 417/269 |
| 2006/0127233 | A1 * | 6/2006 | Sasayama et al. | 417/269 |
| 2006/0153698 | A1 * | 7/2006 | Makino et al. | 417/269 |
| 2006/0269421 | A1 * | 11/2006 | Sakikawa et al. | 417/53 |
| 2007/0089620 | A1 * | 4/2007 | Kim | B41F 15/36 101/123 |

FOREIGN PATENT DOCUMENTS

| | | | |
|---|---|---|---|
| GB | 1272528 | A | 5/1972 |
| JP | H06-8777 | U | 2/1994 |
| JP | 2002-031040 | A | 1/2002 |
| JP | 2002-161849 | A | 6/2002 |
| JP | 2004-003487 | A | 1/2004 |
| JP | 2005-146861 | A | 6/2005 |
| JP | 2008-249099 | A | 10/2008 |

OTHER PUBLICATIONS

An Office Action; "Notification of Reason for Rejection," issued by the Japanese Patent Office on Mar. 11, 2016, which corresponds to Japanese Patent Application No. 2012-042266 and is related to U.S. Appl. No. 13/776,284; with English language translation.

An Office Action; "Decision of Rejection," issued by the Japanese Patent Office on Oct. 28, 2016, which corresponds to Japanese Patent Application No. 2012-042266 and is related to U.S. Appl. No. 13/776,284; with English language translation.

An Office Action; "Decision of Dismissal of Amendment," issued by the Japanese Patent Office on Oct. 28, 2016, which corresponds to Japanese Patent Application No. 2012-042266 and is related to U.S. Appl. No. 13/776,284; with English language translation.

The extended European search report issued by the European Patent Office on Jan. 30, 2017, which corresponds to European Patent Application No. 13156713.3-1616 and is related to U.S. Appl. No. 13/776,284.

* cited by examiner

HYDRAULIC PUMP

CROSS-REFERENCE TO RELATED APPLICATION

This application claims priority to Japanese Patent Application No. 2012-42266. The entire disclosure of Japanese Patent Application No. 2012-42266 is hereby incorporated herein by reference.

BACKGROUND OF THE INVENTION

Field of the Invention

The present invention relates to a swash plate type hydraulic pump including a swash plate that can be installed obliquely inclined relative to a rotational shaft and a plurality of pistons whose axial displacement is defined by the swash plate and that rotate around the rotational shaft.

Description of Related Art

Conventionally, a swash plate type hydraulic pump is known that includes a swash plate that can be installed obliquely inclined relative to a rotational shaft, and a plurality of pistons whose axial displacement is defined by the swash plate and that rotate around the rotational shaft. A hydraulic pump such as the one mentioned above is disclosed in the article entitled "VARIABLE DISPLACEMENT PISTON PUMP-P**V SERIES", which is published on the website of TOKYO KEIKI INC. In the case of the hydraulic pump disclosed in the aforementioned article of TOKYO KEIKI INC., a cylinder block that rotates with a rotational shaft receiving input of torque is provided with a plurality of cylinder chambers extending parallel to the rotational shaft. Also, a plurality of pistons are supported relative to the respective cylinder chambers such that the pistons can be slidably displaced along a direction parallel to the rotational shaft. Note that the above-described article of TOKYO KEIKI INC. is published on the Internet at the URL "http://www.tokyo-keiki.co.jp/hyd/j/products/pdf/a_002-005.pdf".

In the case of the above-described hydraulic pump, oil is sucked into the cylinder chambers while the cylinder block makes a half rotation, the pressure of the oil is raised in the cylinder chambers while the cylinder block makes a further half rotation, and the oil is discharged. Then, the pressure oil discharged from the hydraulic pump will be supplied to various devices. Further, a shoe structure that slides against the swash plate is provided at the end portions of the pistons of the above-described hydraulic pump. With the provision of this shoe structure, the above-described hydraulic pump is configured such that the pistons can slide against the swash plate installed in the housing in a state in which it is obliquely inclined relative to the rotational shaft.

Note that JP 2008-249099A discloses, as a mechanism of a type completely different from a hydraulic pump that supplies pressure oil to various devices, a motorcycle hydrostatic continuously variable transmission configured by connecting a swash plate type plunger hydraulic pump with a swash plate type plunger hydraulic motor via a hydraulic closed circuit. This hydrostatic continuously variable transmission is configured to perform lockup by closing the hydraulic closed circuit when the amount of the oil flowing from the hydraulic pump to the hydraulic motor is decreased in accordance with the variable control of the inclination angle of the swash plate of the hydraulic motor such that the input rotation of the hydraulic pump and the output rotation of the hydraulic motor are substantially synchronous.

Further, in the hydraulic pump of the above-described hydrostatic continuously variable transmission, the torque that is output from the engine is input to a pump casing (20) via a gear. Also, a swash plate (pump swash plate member 21), a pump cylinder (22), and a plurality of pistons (pump plungers 23) are disposed inside the pump casing. The swash plate is installed so as to be rotatable relative to the pump casing in a state in which the swash plate is inclined at a predetermined angle relative to the rotation center axis of the pump casing. The pistons are respectively disposed in a plurality of cylinder chambers (pump plunger holes 22*a*) that are provided in the pump cylinder installed facing the swash plate.

Also, in the hydraulic pump of the above-described hydrostatic continuously variable transmission, the swash plate pivots as a result of the pump casing being rotatably driven by the torque from the engine, and the pistons reciprocate in the cylinder chamber in response to the pivot movement of the swash plate. Thereby, pressure oil is discharged to the hydraulic motor. In this hydraulic pump, in place of the shoe structure that slides against the swash plate, the end portions of the pistons fittingly engage with recessed portions formed in the swash plate. Thereby, this hydraulic pump is configured such that the pistons reciprocate in response to the pivot movement of the swash plate.

SUMMARY OF THE INVENTION

In the hydraulic pump disclosed in the above-described article of TOKYO KEIKI INC., the shoe structure is provided at the end portions of the pistons such that the pistons can slide along the swash plate. Accordingly, there is the problem that friction caused between the swash plate and the shoe that slides against the swash plate results in a large energy loss, which leads to a reduction in efficiency. Further, in order to reduce the above-described friction caused between the swash plate and the shoe, the above-described shoe structure is configured such that a portion of the oil in the cylinder chambers is supplied as lubricating oil between the swash plate and the shoe via the holes formed in the pistons. With this configuration, however, there is the problem of an increased oil leakage inside the hydraulic pump, resulting in an increased work load of the hydraulic pump and thus a reduction in efficiency.

Note that the hydraulic pump of the hydrostatic continuously variable transmission disclosed in JP 2008-249099A is configured such that the pistons reciprocate in response to the pivot movement of the swash plate, and therefore, the end portions of the pistons engage with the swash plate, and the hydraulic pump is not provided with a shoe structure that slides against the swash plate. However, this hydraulic pump is used in an application as a transmission configured by being connected with the hydraulic motor via the hydraulic closed circuit. Further, due to the configuration in which the end portions of the pistons engage with the swash plate, there is the problem that a reduction in efficiency tends to occur owing to friction.

In view of the foregoing circumstances, it is an object of the present invention to provide a hydraulic pump that can achieve an increased efficiency for a swash plate type hydraulic pump by suppressing a reduction in efficiency caused by friction and internal oil leakage.

According to a first feature of a hydraulic pump of the present invention for achieving the above-described object, there is provided a hydraulic pump having a swash plate that can be installed obliquely inclined relative to a rotational shaft and a plurality of pistons whose axial displacement is defined by the swash plate and that rotate around the rotational shaft, including: the rotational shaft receiving input of torque that is output from an electric motor; a housing that rotatably supports the rotational shaft; a cylinder block that is installed inside the housing, provided with a plurality of cylinder chambers extending parallel to the rotational shaft, and rotates with the rotational shaft; the pistons being supported relative to the respective cylinder chambers in the cylinder block so as to be slidably displaceable along a direction parallel to the rotational shaft; the swash plate coming into contact with ends of the pistons and being rotatable around the rotational shaft with the pistons, and being rotatable about a rotation centerline that is obliquely inclined relative to the rotational shaft; a case that is installed inside the housing and pivotably supported relative to the housing; and a bearing portion that holds the swash plate relative to the case so as to be rotatable about the rotation centerline, wherein the pistons reciprocate in the cylinder chambers with rotation of the rotational shaft, whereby the pressure of oil sucked into the cylinder chambers is raised and thereafter the oil is discharged.

With this configuration, when the rotational shaft is rotationally driven as a result of the torque from the electric motor being input, the cylinder block rotates with the rotational shaft, and the pistons rotate around the rotational shaft with the cylinder block. Meanwhile, the swash plate is rotatably held via the bearing portion relative to the case that is pivotably supported relative to the housing. Then, with the rotation of the pistons around the rotational shaft, the swash plate with which the end portions of the pistons come into contact rotates about the rotation centerline that is obliquely inclined relative to the rotational shaft. Thereby, the pistons reciprocate in the respective cylinder chambers as a result of rotation of the rotational shaft, whereby the pressure of the oil sucked into the cylinder chambers is raised and thereafter the oil is discharged.

As described above, the hydraulic pump having the above-described configuration, the swash plate rotatably held by the case via the bearing portion rotates with the cylinder block and the pistons. Accordingly, with the hydraulic pump, any shoe structure is not provided between the end portions of the pistons and the swash plate, and therefore a reduction in efficiency as in the case of hydraulic pumps of the related art can be suppressed. That is, the hydraulic pump does not suffer from a reduction in efficiency resulting from an energy loss caused by friction between a shoe and the swash plate, and moreover, it does not suffer from a reduction in efficiency resulting from internal oil leakage caused by part of the oil inside the cylinder chambers being supplied between a shoe and the swash plate as lubricating oil. Therefore, with the hydraulic pump, a shoeless structure different from conventional swash plate type hydraulic pumps can be realized, which makes it possible to suppress a reduction in efficiency caused by friction and internal oil leakage, thus increasing the efficiency. Furthermore, as a result of increasing the efficiency of the hydraulic pump, it is also possible to reduce the heat generation during operation of the hydraulic pump.

Therefore, with the above-described configuration, it is possible to provide a swash plate type hydraulic pump that can suppress a reduction in efficiency caused by friction and internal oil leakage, thus increasing the efficiency. Note that the present inventor analyzed the efficiency of a conventional swash plate type hydraulic pump including a shoe structure and the efficiency of a swash plate type hydraulic pump to which the above-described configuration is applied, and examined the effect of improving the efficiency. As a result, the efficiency, which is the ratio of the effective energy output from the hydraulic pump to the energy that is input to the hydraulic pump, is 75 to 80% for the conventional hydraulic pump including a shoe structure, whereas it was confirmed that a high efficiency of 85 to 90% can be achieved in the case of the hydraulic pump to which the above-described configuration is applied. Accordingly, it was verified that the above-described configuration can realize a significant improvement in efficiency.

According to a second feature of a hydraulic pump of the present invention, in the hydraulic pump of the first feature, an end face of the swash plate that comes into contact with the pistons is flattened, and a curved surface constituting part of a spherical surface having a predetermined size of radius of curvature is formed on an end portion of each of the pistons that comes into contact with the swash plate.

With this configuration, in the pistons and the swash plate that come into contact with each other, the contacting end face of the swash plate is flattened, and the curved surface constituting part of a spherical surface is formed on the contacting end portion of the piston. Accordingly, the swash plate rotatably held relative to the case via the bearing portion can be smoothly rotated with the cylinder block and the pistons. Therefore, it is possible to achieve a further improvement in efficiency.

According to a third feature of a hydraulic pump of the present invention, in the hydraulic pump of the first or second feature, the bearing portion includes a ball-shaped rolling element.

With this configuration, the rolling element of the bearing portion that rotatably supports the swash plate relative to the case is provided in a ball shape, and therefore, the swash plate can be further smoothly rotated with the cylinder block and the pistons. Therefore, it is possible to achieve a further improvement in efficiency. Further, since the rolling element is provided in a ball shape, it is possible to reduce the size of the bearing portion, as compared to the cases where a roller-shaped rolling element is provided. This makes it possible to reduce the size of the hydraulic pump.

According to a fourth feature of a hydraulic pump of the present invention, in the hydraulic pump of any one of the first to third features, the bearing portion includes a rolling element formed of a ceramic material.

With this configuration, the rolling element of the bearing portion is formed of a ceramic material, and it is therefore possible to reduce the contact pressure generated between the rolling element and each of the inner ring and the outer ring in the bearing portion, thus improving the pressure resistance of the bearing portion. This makes it possible to easily provide a configuration adapted to higher pressure for the swash plate type hydraulic pump whose efficiency has been increased by suppressing a reduction in efficiency caused by friction and internal oil leakage.

According to a fifth feature of a hydraulic pump of the present invention, in the hydraulic pump of any one of the first to fourth features, the bearing portion includes: an inner ring to which the swash plate is fixed or that is provided integrally with the swash plate; an outer ring that is fixed to the case; and a rolling element that rolls between the inner ring and the outer ring.

With this configuration, in the bearing portion, the inner ring is fixed to, or integrally provided with the swash plate and the outer ring is fixed to the case. Accordingly, the bearing portion that rotatably holds the swash plate relative to the case pivotably supported relative to the housing can be realized with a simple structure in a compact manner.

According to a sixth feature of a hydraulic pump of the present invention, in the hydraulic pump of the fifth feature, the swash plate is provided with a tubular part that is formed in a tubular shape, and the inner ring is formed separately from the swash plate and is fixed to an outer circumference of the tubular part.

With this configuration, the inner ring of the bearing portion is fixed to the outer circumference of the tubular part provided in the swash plate, and therefore, the bearing portion can be easily replaced at the time of maintenance. This makes it possible to achieve further improvement in the ease of maintenance for the swash plate type hydraulic pump whose efficiency has been increased by suppressing a reduction in efficiency caused by friction and internal oil leakage.

According to a seventh feature of a hydraulic pump of the present invention, the hydraulic pump of any one of the first to sixth features further includes a piston biasing mechanism that is supported relative to the cylinder block and includes a spring that biases the pistons toward the swash plate.

With this configuration, during initial actuation in which the operation of the initial hydraulic pump is started, the pistons are biased toward the swash plate by the biasing force of the spring of the piston biasing mechanism. Accordingly, a state in which the end portions of the pistons are in contact with the swash plate is maintained during initial actuation of the hydraulic pump, and thus a stable starting characteristic is ensured.

According to an eighth feature of a hydraulic pump of the present invention, in the hydraulic pump of the seventh feature, the piston biasing mechanism includes: the spring being supported relative to the cylinder block, directly or via a pedestal portion held by the cylinder block; a retainer that is attached to the spring at an end portion of the spring on a side opposite the cylinder block; and a planar piston biasing plate that is pivotably held relative to the retainer, and transmits biasing force from the spring to bias the pistons toward the swash plate, wherein each of the pistons passes through a hole provided in the piston biasing plate, and can be engaged with the piston biasing plate on a side opposite the cylinder block.

With this configuration, the piston biasing mechanism that can ensure a stable starting characteristic during initial actuation of the hydraulic pump can be constructed in a compact manner with a simple structure including the spring, the retainer attached to the end portion of the spring, and the piston biasing plate that is pivotably held by the retainer and is engaged with the pistons.

It should be appreciated that the above and other objects, and features and advantages of the present invention will become apparent from the following description taken in conjunction with the accompanying drawings.

DETAILED DESCRIPTION OF THE INVENTION

Hereinafter, an embodiment of the present invention will be described with reference to the accompanying drawings. Note that the embodiment of the present invention can be widely applied as a swash plate type hydraulic pump including a swash plate that can be installed obliquely inclined relative to a rotational shaft, and a plurality of pistons whose axial displacement is defined by the swash plate and that rotate around the rotational shaft.

Figure 1:
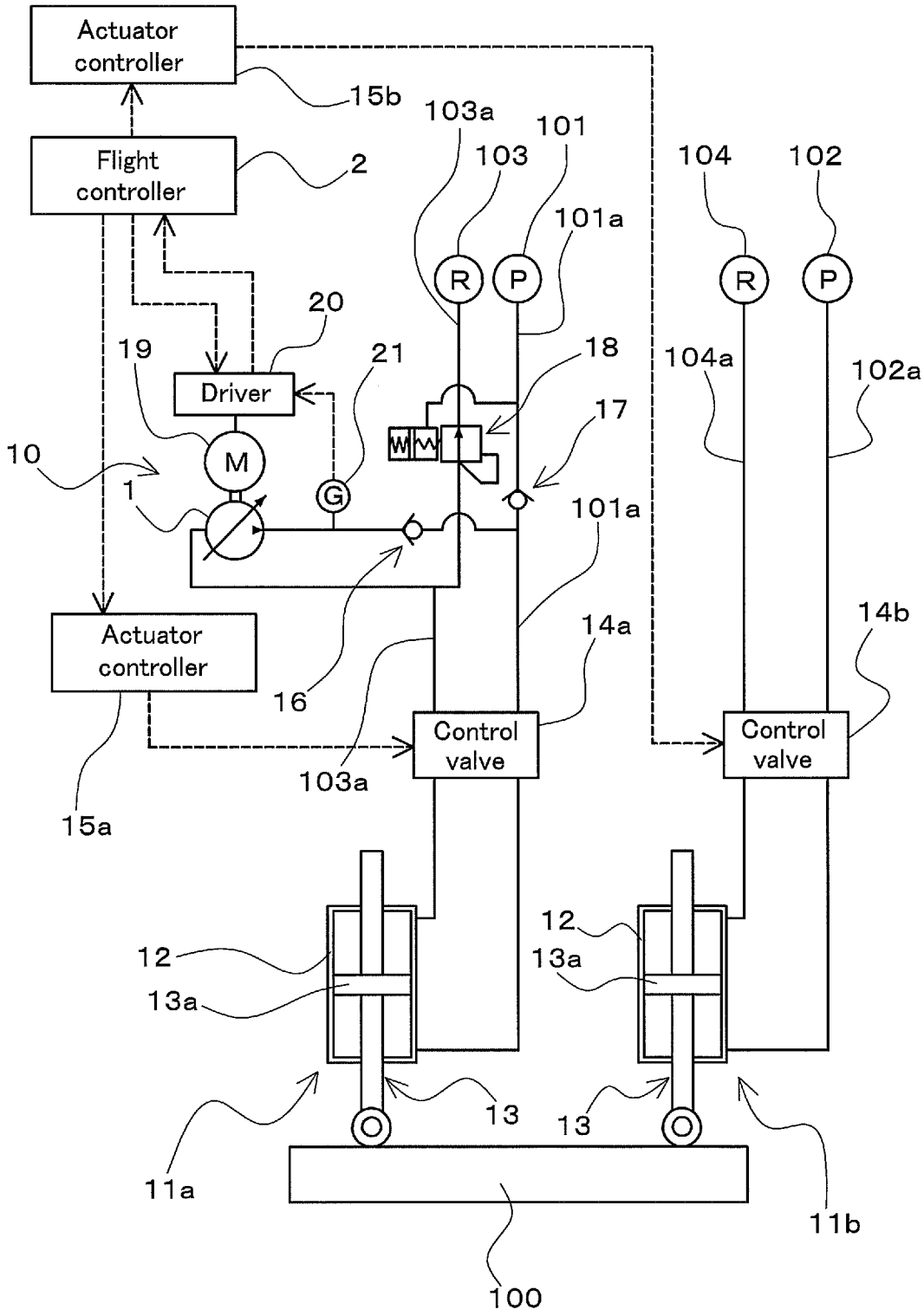
FIG. 1 is a hydraulic circuit diagram schematically showing a hydraulic circuit including a hydraulic pump according to an embodiment of the present invention.

FIG. 1 is a hydraulic circuit diagram schematically showing a hydraulic circuit including a hydraulic pump 1 according to an embodiment of the present invention. The present embodiment will be described, taking as an example, a case where the hydraulic pump 1 is a backup hydraulic pump installed in an aircraft (not shown). In the following description, a description will be first given of a hydraulic circuit to which a hydraulic pump 1 and a hydraulic system 10 including the hydraulic pump 1 are applied, and a description will be then given of the hydraulic pump 1 and the hydraulic system 10.

Note that the application of the hydraulic pump 1 as a backup hydraulic pump installed in an aircraft and that of the hydraulic system 10 including the hydraulic pump 1 are merely examples. The hydraulic pump 1 and the hydraulic system 10 of the present embodiment can be widely used as other hydraulic pumps and hydraulic systems for use as backup hydraulic pumps installed in aircrafts, hydraulic pumps and hydraulic systems installed in various vehicles, or hydraulic pumps and hydraulic systems for supplying pressure oil to various hydraulically operated devices.

The hydraulic pump 1, which is provided as a backup hydraulic pump in the hydraulic circuit shown in FIG. 1, is provided as a hydraulic pump for supplying pressure oil to an actuator 11*a* that drives a moving surface 100 of an aircraft (not shown). Also, the moving surface 100 is provided as a flight control surface of the aircraft, and may be configured as a control surface such as an aileron provided in the main wing, an elevator provided in the tailplane, or a rudder provided in the vertical tail. Alternatively, the moving surface 100 may be configured as a spoiler provided as a flight spoiler or a ground spoiler, or a flap or the like.

The moving surface 100 shown in FIG. 1 is provided in a fixed wing. When the moving surface 100 is provided, for example, as an elevator, it is provided on a tailplane serving as a fixed wing. Also, the moving surface 100 is configured to be driven by a plurality of (for example, two) actuators (11*a*, 11*b*). Further, the actuators (11*a*, 11*b*) for driving the moving surface 100 and the hydraulic pump 1 configured to supply pressure oil to one of the actuators, namely, the actuator 11*a*, are installed inside the fixed wing on which the moving surface 100 is installed.

As shown in FIG. 1, each of the actuators (11*a*, 11*b*) includes a cylinder 12, a rod 13 provided with a piston 13*a*, and so forth. The interior of the cylinder 12 is divided by the piston 13*a* into two oil chambers that are not in communication with each other. Also, the oil chambers in the cylinder 12 of the actuator 11*a* are respectively configured to be in communication with a first aircraft central hydraulic power source 101 and a reservoir circuit 103 via a control valve 14*a*. Meanwhile, the oil chambers in the cylinder 12 of the actuator 11*b* are respectively configured to be in communication with a second aircraft central hydraulic power source 102 and a reservoir circuit 104 via a control valve 14*b*.

The first aircraft central hydraulic power source 101 and the second aircraft central hydraulic power source 102 are provided as hydraulic power sources each including a hydraulic pump that supplies pressure oil and are installed on the body side (inside the body), which is not shown, as systems that are independent of each other. Then, as a result of the pressure oil being supplied from the first and second aircraft central hydraulic power sources (101, 102), the actuators (11*a*, 11*b*) for driving the moving surface 100 and actuators (not shown) for driving moving surfaces other than the moving surface 100 are operated. Note that the hydraulic pump 1 of the present embodiment may be applied as the hydraulic pump provided in the first aircraft central hydraulic power source 101 or the second aircraft central hydraulic power source 102.

The reservoir circuit 103 includes a tank (not shown) into which oil (hydraulic fluid) that is supplied as pressure oil to one of the oil chambers of the actuator 11*a* and is thereafter discharged from that oil chamber flows back, and the reservoir circuit 103 is further configured to be in communication with the first aircraft central hydraulic power source 101. The reservoir circuit 104 that is configured as a system independent of the reservoir circuit 103 includes a tank (not shown) into which oil (hydraulic fluid) that is supplied as pressure oil to one of the oil chambers of the actuator 11*b* and is thereafter discharged from that oil chamber flows back, and the reservoir circuit 104 is further configured to be in communication with a second aircraft central hydraulic power source 102 that is configured as a system independent of the first aircraft central hydraulic power source 101. Further, the pressure of the oil that has returned to the reservoir circuit 103 is raised by the first aircraft central hydraulic power source 101 and is supplied to the actuator 11*a*. Meanwhile, the pressure of oil that has returned to the reservoir circuit 104 is raised by the second aircraft central hydraulic power source 102 and is supplied to the actuator 11*b*.

The control valve 14*a* is provided as a valve mechanism that switches the state of connection of the oil chambers of the actuator 11*a* with a supply path 101*a* that is in communication with the first aircraft central hydraulic power source 101 and an discharge path 103*a* that is in communication with the reservoir circuit 103. The control valve 14*b* is provided as a valve mechanism that switches the state of connection of the oil chambers of the actuator 11*b* with a supply path 102*a* that is in communication with the second aircraft central hydraulic power source 102 and a discharge path 104*a* that is in communication with the reservoir circuit 104. The control valve 14*a* may be configured, for example, as an electrohydraulic servo valve, and may be driven based on a command signal from an actuator controller 15*a* that controls operation of the actuator 11*a*. The control valve 14*b* may be configured, for example, as an electrohydraulic servo valve, and may be driven in accordance with a command signal from an actuator controller 15*b* that controls operation of the actuator 11*b*.

The above-described actuator controller 15*a* controls the actuator 11*a* based on a command signal from a flight controller 2, which is a superordinate computer that commands operation of the moving surface 100, of the hydraulic system 10. The actuator controller 15*b* controls the actuator 11*b* based on a command signal from the flight controller 2.

Further, the control valve 14*a* described above is switched based on a command from the actuator controller 15*a*, and thereby pressure oil is supplied from the supply path 101*a* to one of the oil chambers of the cylinder 12 and the oil is discharged from the other of the oil chambers to the discharge path 103*a*. Consequently, the rod 13 is displaced relative to the cylinder 12, thus driving the moving surface 100. Note that the control valve 14*b* is configured in the same manner as the control valve 14*a* described above, and therefore the description thereof is omitted.

The hydraulic pump 1, which will be described below, is provided as a backup hydraulic pump that is installed inside a fixed wing (not shown) on which the moving surface 100 is provided, and supplies pressure oil to the hydraulically operated actuator 11*a* for driving the moving surface 100. The suction side of the hydraulic pump 1 is connected in communication with the discharge path 103*a*, and its discharge side is connected in communication with the supply path 101*a* via a check valve 16 so as to be able to supply pressure oil to the supply path 101*a*. Also, the hydraulic pump 1 is configured to be able to supply pressure oil to the actuator 11*a* at the occurrence of a loss or degradation of the function (pressure oil supply function) of the first aircraft central hydraulic power source 101 due to a failure of the hydraulic pump, an oil leakage, or the like in the first aircraft central hydraulic power source 101. Note that a pressure sensor 21 is connected between the hydraulic pump 1 and the check valve 16. The pressure of the pressure oil on the discharge side of the hydraulic pump 1 is detected by the pressure sensor 21.

A check valve 17 for permitting flow of pressure oil into the actuator 11*a* and preventing flow of the oil in the opposite direction is provided upstream (on the first aircraft central hydraulic power source 101 side) of a location of the supply path 101*a* where the discharge side of the hydraulic pump 1 is connected. Further, a relief valve 18 for discharging pressure oil into the reservoir circuit 103 when the pressure of the oil discharged from the actuator 11*a* rises is provided downstream (on the reservoir circuit 103 side) of a location of the discharge path 103*a* where the suction side of the hydraulic pump 1 is connected. Also, the relief valve 18 is provided with a pilot pressure chamber that is in communication with the supply path 101*a* and in which a spring is disposed. When the pressure of the pressure oil supplied from the supply path 101*a* decreases below a predetermined pressure value, the pressure of the pressure oil being supplied as a pilot pressure oil to the pilot pressure chamber (pilot pressure) from the supply path 101*a* also decreases below the predetermined pressure value, as a result of which the discharge path 103*a* is blocked by the relief valve 18. In the case of a loss or degradation of the function of the first aircraft central hydraulic power source 101, the provision of the above-described check valves (16, 17) and the relief valve 18 allows the pressure of the oil discharged from the actuator 11*a* to be raised by the hydraulic pump 1 without returning the oil to the reservoir circuit 103, and the pressure oil is supplied to the actuator 11*a* with an increased pressure.

The electric motor 19 is installed inside the fixed wing (not shown) on which the moving surface 100 is provided, together with the hydraulic pump 1. Also, the electric motor 19 is coupled to the hydraulic pump 1 via a coupling or a gear mechanism, and is configured to drive the hydraulic pump 1. The operational status of the electric motor 19 is controlled via the driver 20, in accordance with a command signal from the flight controller 2. Note that the driver 20 is provided as a circuit board or the like that drives the electric motor 19 by controlling the current supplied to the electric motor 19 and the running speed (rotational speed) of the electric motor 19 in accordance with a command signal from the flight controller 2.

Figure 2:
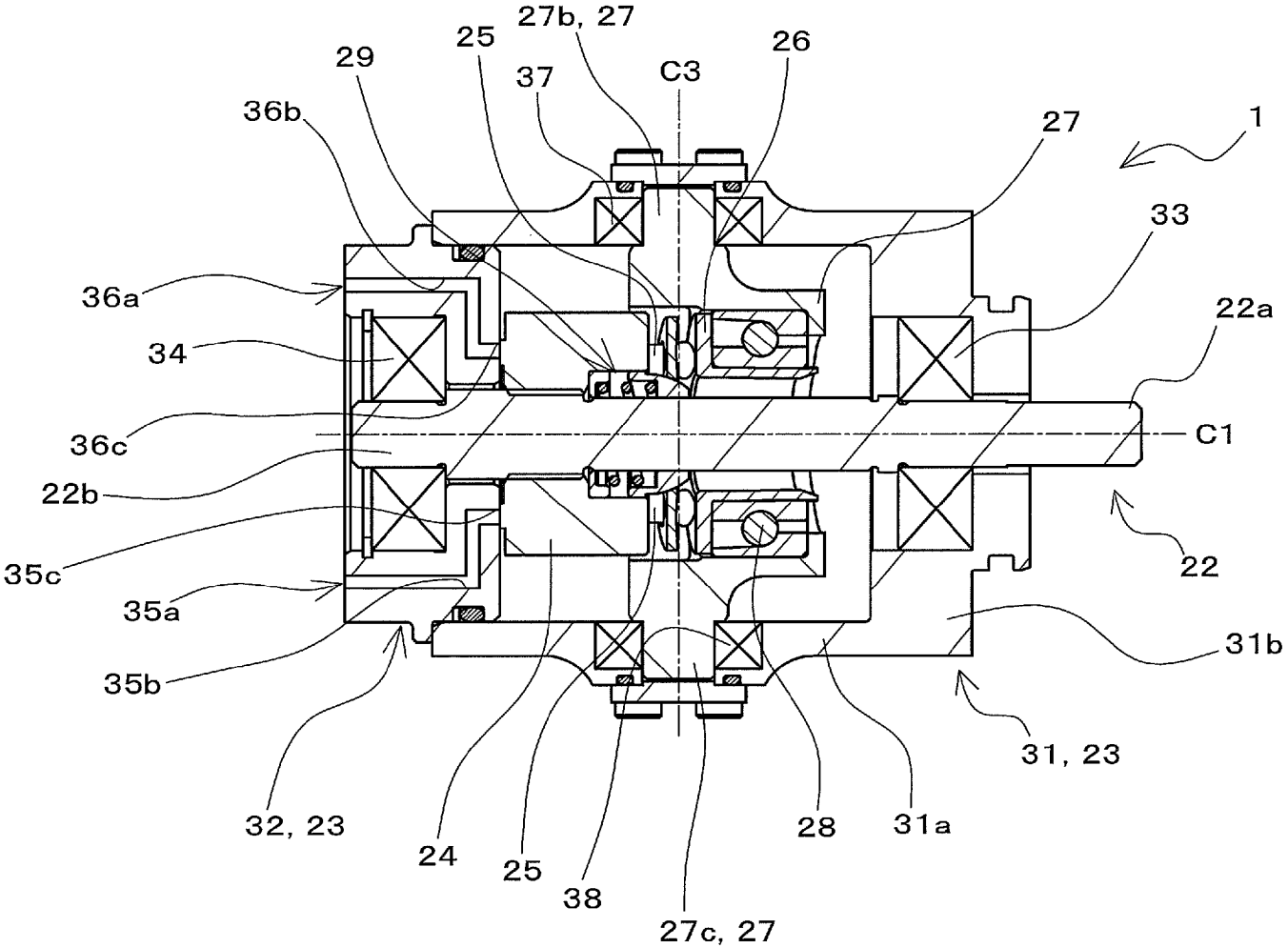
FIG. 2 is a cross-sectional view of the hydraulic pump shown in FIG. 1.
Figure 3:
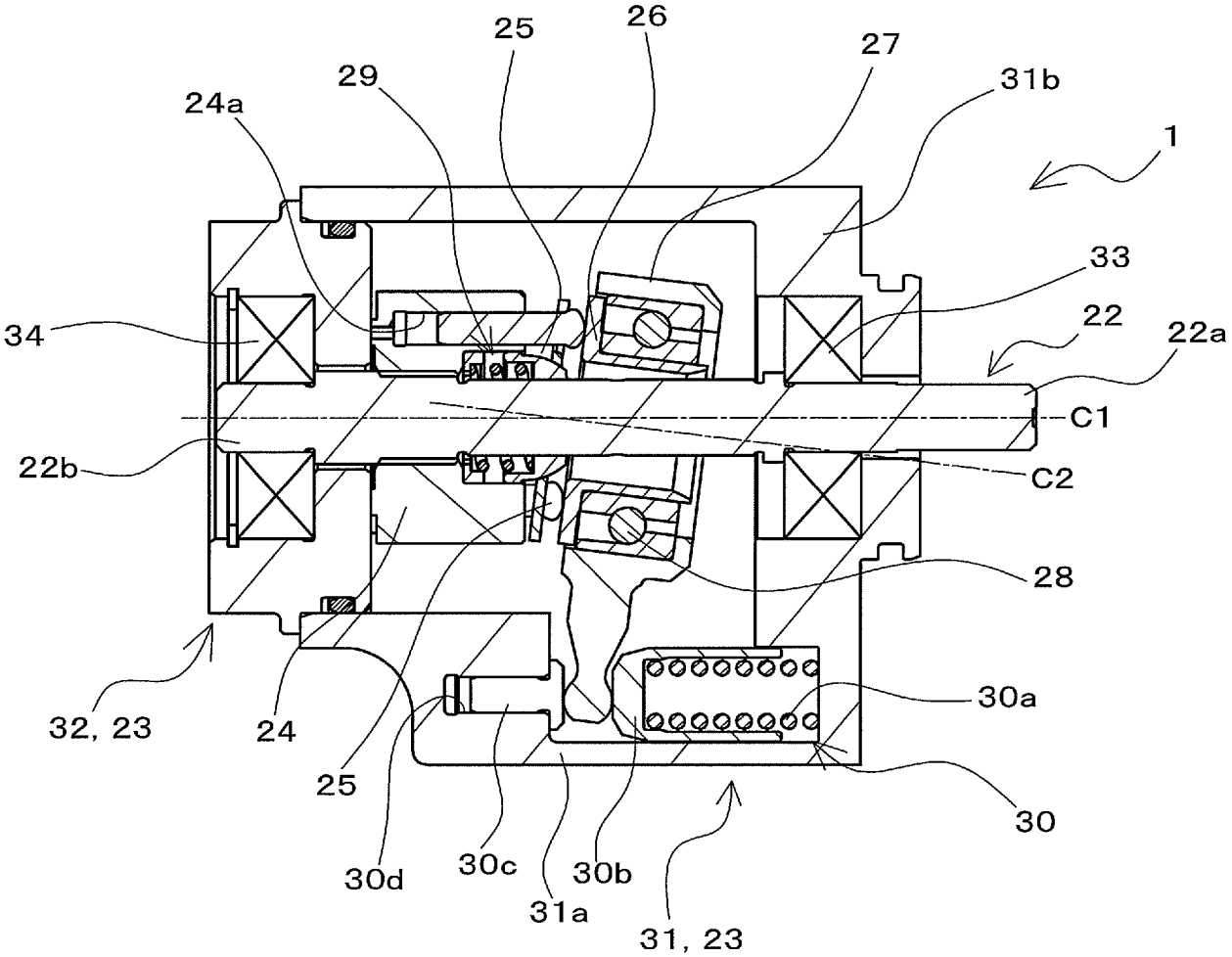
FIG. 3 is a cross-sectional view showing a cross section of the hydraulic pump of FIG. 1 that is different from the cross section shown in FIG. 2.
Figure 4:
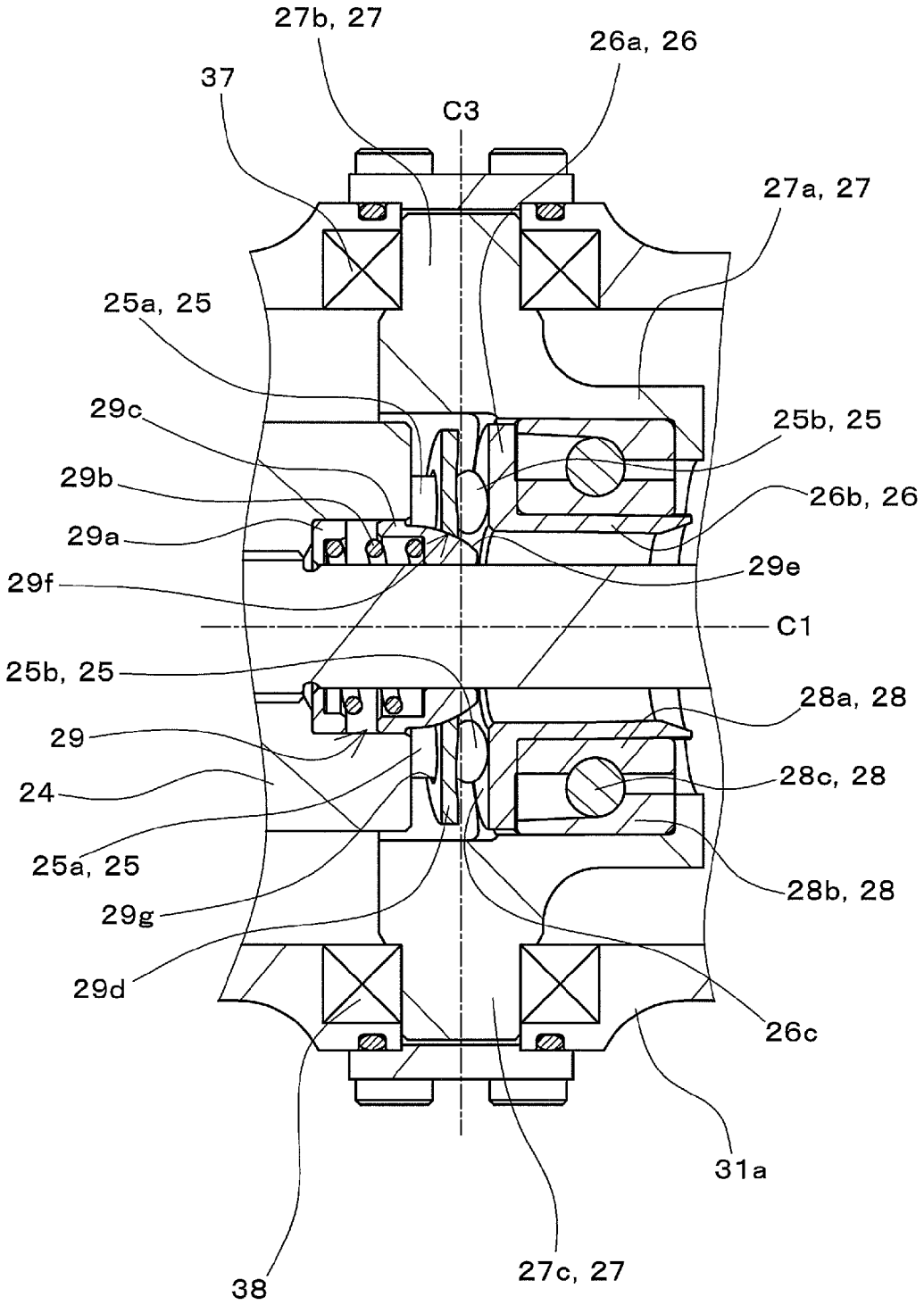
FIG. 4 is an enlarged cross-sectional view showing part of FIG. 2.
Figure 5:
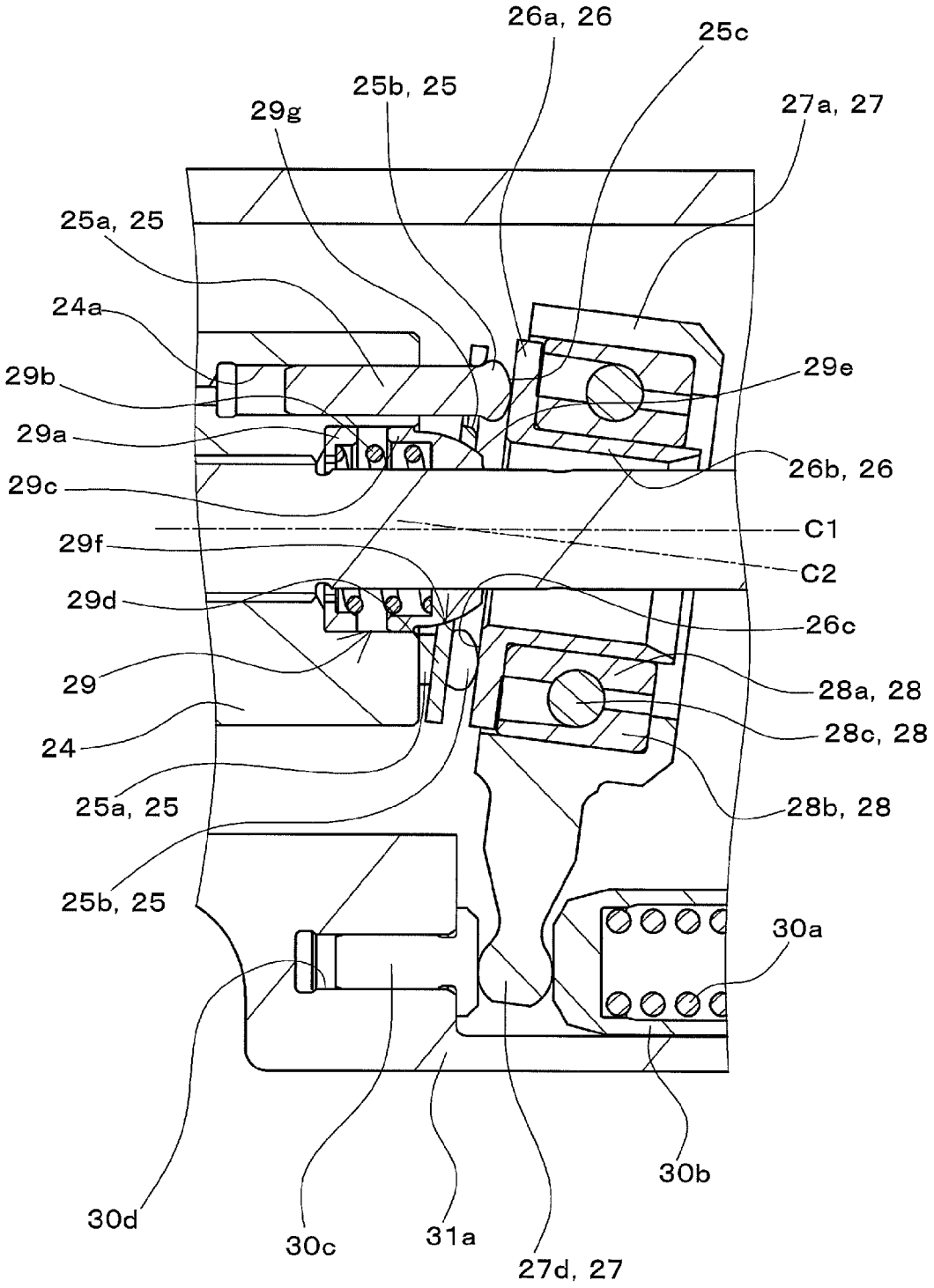
FIG. 5 is an enlarged cross-sectional view showing part of FIG. 3.

Next, the hydraulic pump 1 of the present embodiment will be described in detail. FIG. 2 is a cross-sectional view of the hydraulic pump 1. FIG. 3 is a cross-sectional view showing a cross section of the hydraulic pump 1 that is different from the cross section shown in FIG. 2. FIG. 4 is an enlarged cross-sectional view showing part of FIG. 2. FIG. 5 is an enlarged cross-sectional view showing part of FIG. 3. The hydraulic pump 1 is provided as a swash plate type hydraulic pump. The hydraulic pump 1 includes a rotational shaft 22, a housing 23, a cylinder block 24, a plurality of pistons 25, a swash plate 26, a case 27, a bearing portion 28, a piston biasing mechanism 29, a pivot drive mechanism 30, and so forth.

The rotational shaft 22 is provided as a round-bar-shaped shaft member that receives input of torque output from the electric motor 19. Also, the rotational shaft 22 is, at one longitudinal end portion 22*a* thereof, directly coupled to the electric motor 19 by a coupling (not shown), or coupled to the electric motor 19 via a gear mechanism (not shown).

The housing 23 is provided as a structure that rotatably holds the rotational shaft 22 via a pair of rotational shaft bearings (33, 34) and contains the cylinder block 24, the swash plate 26, and so forth. Also, the housing 23 is configured by a first housing member 31 and a second housing member 32 that are assembled and fixed together.

The first housing member 31 is provided with a substantially cylindrically shaped tubular portion 31*a* and a disk portion 31*b* that is provided integrally with one end portion of the tubular portion 31*a* and is formed as a disk-like portion. A recessed portion into which the rotational shaft bearing 33 is fitted is formed at the central part of the disk portion 31*b*. Also, the disk portion 31*b* rotatably holds the rotational shaft 22, which passes through its central part, via the rotational shaft bearing 33 on the end portion 22*a* side.

The second housing member 32 is provided as a disk-like member that closes the tubular portion 31*a* of the first housing member 31. The second housing member 32 is fixed to the first housing member 31 at the end portion of the tubular portion 31*a* on the side opposite the disk portion 31*b*. Also, a recessed portion into which the rotational shaft bearing 34 is fitted is formed at the central part of the second housing member 32. The second housing member 32 rotatably holds the rotational shaft 22, which passes through its central part, at the other end portion 22*b* via the rotational shaft bearing 34.

Further, the second housing member 32 is provided with a suction port 35*a*, a suction oil path 35*b*, a suction communication path 35*c*, a discharge port 36*a*, a discharge oil path 36*b*, and a discharge communication path 36*c*.

The suction port 35*a* is open toward the outside of the second housing member 32, and is connected to the discharge path 103*a* so as to be in communication therewith. The suction communication path 35*c* is formed as a space area extending in an arc shape in the circumferential direction around the rotational shaft 22. Also, the suction communication path 35*c* is provided so as to be in communication with half of the plurality of cylinder chambers 24*a* of the cylinder block 24, which will be described below, that rotate with the rotational shaft 22. The suction oil path 35*b* is provided as an oil path that provides communication between the suction port 35*a* and the suction communication path 35*c*.

Upon rotation of the cylinder block 24, the oil flowing through the discharge path 103*a* is sucked, via the suction port 35*a*, the suction oil path 35*b*, and the suction communication path 35*c*, into the cylinder chambers 24*a* in communication with the suction communication path 35*c*. Note that, as the cylinder block 24 rotates, the half of the cylinder chambers 24*a* in communication with the suction communication path 35*c* are sequentially switched on a portion-by-portion basis.

The discharge port 36*a* is open toward the outside of the second housing member 32, and is connected to the supply path 101*a* so as to be in communication therewith. The discharge communication path 36*c* is formed as a space area extending in an arc shape in the circumferential direction around the rotational shaft 22. Also, the discharge communication path 36*c* is provided so as to be in communication with half of the plurality of cylinder chambers 24*a* of the cylinder block 24 that rotates with the rotational shaft 22. The discharge oil path 36*b* is provided as an oil path that provides communication between the discharge port 36*a* and the discharge communication path 36*c*.

Upon rotation of the cylinder block 24, the pressure oil is discharged, via the discharge communication path 36*c*, the discharge oil path 36*b*, and the discharge port 36*a*, from the cylinder chamber 24*a* in communication with the discharge communication path 36*c* to the supply path 101*a*. Note that, as the cylinder block 24 rotates, the half of the cylinder chambers 24*a* in communication with the discharge communication path 36*c* are sequentially switched on a portion-by-portion basis.

The cylinder block 24 is configured as a member provided with the plurality of cylinder chambers 24*a*, and is installed inside the housing 23. The cylinder chambers 24*a* are provided such that they are disposed with an equiangular interval along the circumferential direction about the center axis C1 (the center axis C1 indicated by the dash-dotted lines in FIGS. 2 to 4) of the rotational shaft 22, and each extend along a direction parallel to the rotational shaft 22. The pistons 25, which will be described below, are disposed in the respective cylinder chambers 24*a*.

Further, a through hole provided with spline grooves is formed at the center of the cylinder block 24. Meanwhile, the rotational shaft 22, which passes through the through hole at the center of the cylinder block 24, is provided with spline teeth. Then, the cylinder block 24 and the rotational shaft 22 are spline-coupled to each other via meshing between the spline grooves of the cylinder block 24 and the spline teeth of the rotational shaft 22. Thereby, the cylinder block 24 is configured to rotate with the rotational shaft 22 about the center axis C1 as a result of rotation of the rotational shaft 22.

A plurality of pistons 25 are provided, and are supported relative to the respective cylinder chambers 24*a* of the cylinder block 24 so as to be slidably displaceable in a direction parallel to the rotational shaft 22. Also, the axial displacement of the pistons 25 is defined by the swash plate 26, which will be described below, and the pistons 25 are installed so as to rotate around the rotational shaft 22.

Each of the pistons 25 is provided with a piston shaft portion 25*a* and a piston head portion 25*b*. The piston shaft portion 25*a* is provided as a columnar portion, and is supported in the cylinder chamber 24*a* so as to be axially slidable against the inner wall thereof. Note that the axial direction of the piston shaft portions 25*a* of the pistons 25 whose axial direction coincides with the axial direction of the cylinder chambers 24*a* extends parallel to the center axis C1 of the rotational shaft 22. Further, the circumferential displacement of the pistons 25 relative to the inner walls of the cylinder chambers 24*a* is not restrained, and the pistons 25 are supported inside the cylinder chambers 24*a* so as to be slidable against and relatively rotatable with the inner walls in the circumferential direction.

The piston head portions 25*b* are provided as end portions of the respective pistons 25 that come into contact with the swash plate 26, which will be described below. The piston head portions 25*b* are disposed protruding from the respective cylinder chambers 24*a* of the cylinder block 24, and are installed so as to abut against and come into contact with the swash plate 26. Further, each of the piston head portions 25*b* is provided with a curved surface 25*c* constituting part of a spherical surface having a predetermined size of a radius of curvature (see FIG. 5).

The surface of each of the pistons 25, or in other words, the surface of the piston shaft portion 25*a* and the surface of the piston head portion 25*b* are subjected to a coating treatment for providing a diamond like carbon (DLC) coating, and thereby a coating of diamond like carbon is formed thereon. Note that the inner walls of the cylinder chambers 24*a* may also be subjected to a coating treatment for providing a diamond like carbon coating.

The swash plate 26 is rotatably held relative to the case 27, which will be described below, via the bearing portion 28. Also, the swash plate 26 comes into contact with the pistons 25 at the piston head portions 25*b*, which are the end portions of the pistons 25, and are installed so as to able to rotate with the pistons 25 around the rotational shaft 22. Further, the swash plate 26 is configured so as to be able to be installed obliquely inclined relative to the rotational shaft 22. That is, by being supported relative to the case 27 via the bearing portion 28, the swash plate 26 is installed so as to be able to rotate about the rotation centerline C2 (the rotation centerline C2 indicated by the dash-dotted lines in FIGS. 3 and 5), which is obliquely inclined relative to the center axis C1 of the rotational shaft 22, as shown in FIGS. 3 and 5.

Further, the swash plate 26 includes a planar part 26*a* and a tubular part 26*b*. The planar part 26*a* is provided as a planar portion having a disk-like outer shape and a through hole formed at the center. Also, the rotational shaft 22 is disposed passing through the through hole at the center of the planar part 26*a*. Further, an end face 26*c* of the planar part 26*a* that faces the cylinder block 24 is flattened, and constitutes the end face of the swash plate 26 that comes into contact with the plurality of pistons 25. The end face 26*c* of the planar part 26*a* is subjected to a coating treatment for providing a diamond like carbon coating, and a coating of diamond like carbon is formed thereon.

The tubular part 26*b* is formed as a cylindrical portion extending from an edge portion of the through hole at the center of the planar part 26*a*, parallel to a direction perpendicular to the planar part 26*a*. In the present embodiment, the tubular part 26*b* is formed integrally with the planar part 26*a*, and the end portion of the tubular part 26*b* and the edge portion of the through hole of the planar part 26*a* are provided integrally. Further, the rotational shaft 22, which passes through the through hole of the planar part 26*a*, is disposed passing through the inside of the tubular part 26*b* as well. Note that the edge portion of the through hole of the planar part 26*a* and the inner circumference of the tubular part 26*b* are spaced away from the outer circumference of the rotational shaft 22 with a space therebetween, without coming into contact with the rotational shaft 22.

The case 27 is installed inside the housing 23, and is configured to be pivotably supported relative to the housing 23 and to pivot relative to the housing 23 by being driven by the pivot drive mechanism 30. Also, the case 27 is provided with a case main body portion 27*a*, pivot shaft portions (27*b*, 27*c*), and a pivot end portion 27*d*.

The case main body portion 27*a* is formed as a cup-shaped portion composed of a cylindrical portion and a bottom plate-like portion that are integrally provided. Further, the case main body portion 27*a* internally holds the bearing portion 28, which will be described below. Also, the bottom plate-like portion of the case main body portion 27*a* is provided with a through hole at the center, and the rotational shaft 22 is disposed passing through this through hole via a gap.

The pivot shaft portions (27*b*, 27*c*) are provided as columnar portions that are attached to the housing 23 via pivot axis bearings (37, 38). The pivot shaft portions (27*b*, 27*c*) are provided in pairs. Also, the pivot shaft portions (27*b*, 27*c*) are provided integrally with the cylindrical portion of the case main body portion 27*a* on both sides in the diametral direction, and also are provided protruding radially outward in a cantilevered manner.

The pivot shaft portions (27*b*, 27*c*) are rotatably attached to the housing 23 via the pivot axis bearings (37, 38) on both sides in the diametral direction of the tubular portion 31*a* of the first housing member 31. That is, relative to the first housing member 31, the pivot shaft portion 27*b* is pivotably held via the pivot axis bearing 37, and the pivot shaft portion 27*c* is pivotably held via the pivot axis bearing 38.

With the above-described configuration, the case 27 is supported at the pivot shaft portions (27*b*, 27*c*) via the pivot axis bearings (37, 38) so as to be pivotable relative to the housing 23. Further, as described above, the case 27 is configured to pivot relative to the housing 23 in a direction in which it rotates about the center axis C3 (the center axis C3 indicated by the dash-dotted lines in FIGS. 2 and 4) of the pivot shaft portions (27*b*, 27*c*).

The pivot end portion 27*d* is provided as a portion of the case 27 that is driven by the pivot drive mechanism 30, which will be described below. Also, the pivot end portion 27*d* is provided as a portion that protrudes in a cantilevered manner from the cylindrical portion of the case main body portion 27*a*, radially outward thereof. A single pivot end portion 27*d* is provided so as to protrude outward from a single location on the outer circumference of the cylindrical portion of the case main body portion 27*a*. Also, the pivot end portion 27*d* is provided so as to protrude in a direction perpendicular to the direction in which the paired pivot shaft portions (27*b*, 27*c*) are arranged and along the radial direction of the cylindrical portion of the case main body portion 27*a*, relative to the cylindrical portion of the case main body portion 27*a*. Further, a tip portion of the pivot end portion 27*d* is provided with a curved surface constituting part of a spherical surface.

The bearing portion 28 is attached to the case 27, and is provided as a bearing mechanism that holds the swash plate 26. Also, the bearing portion 28 is configured to hold the swash plate 26 relative to the case 27 such that the swash plate 26 can rotate about the rotation centerline C2 that is obliquely inclined relative to the center axis C1 of the rotational shaft 22.

The bearing portion 28 includes an inner ring 28*a*, an outer ring 28*b*, and a plurality of rolling elements 28*c*. The tubular part 26*b* of the swash plate 26 is fitted and fixed to the inner ring 28*a* serving as a ring-shaped member on the inner circumference side thereof. That is, the inner ring 28*a* is formed separately from the swash plate 26, and fixed to the outer circumference of the tubular part 26*b*. Further, the outer ring 28*b* serving as a ring-shaped member disposed on the outside of the inner ring 28*a* and the rolling elements 28*c* is fitted and fixed inside the case main body portion 27*a* of the case 27.

The rolling elements 28*c* are provided as members that roll between the outer circumference of the inner ring 28*a* and the inner circumference of the outer ring 28*b*, and a plurality of rolling elements 28*c* are aligned along the circumferential direction of the inner ring 28*a* and the outer ring 28*b*. Each of the rolling elements 28*c* is provided as a ball-shaped rolling element. That is, the bearing portion 28 is configured as a ball bearing in the present embodiment. Further, the ball-shaped rolling elements 28*c* are formed of a ceramic material. Note that the inner ring 28*a* and the outer ring 28*b* are formed of a ceramic material or a metallic material.

The piston biasing mechanism 29 is provided as a mechanism for biasing the plurality of pistons 25 toward the swash plate 26. The provision of this piston biasing mechanism 29 ensures a state in which the pistons 25 are abutted against the swash plate 26 at the start of operation of the hydraulic pump 1. The piston biasing mechanism 29 includes a pedestal portion 29*a*, a spring 29*b*, a retainer 29*c*, and a piston biasing plate 29*d*.

The pedestal portion 29*a* is formed in the shape of a plate that is fitted into the recessed portion formed in the shape of a hole at the center of the cylinder block 24, and is provided as a member that supports the spring 29*b* relative to the cylinder block 24. An indentation into which the end portion of the spring 29*b* is fitted is formed on the side of the pedestal portion 29*a* opposite the end face that abuts the recessed portion of the cylinder block 24. Further, a through hole in which the rotational shaft 22 is disposed in a state of passing therethrough is formed at the center of the pedestal portion 29*a*.

The spring 29*b* is supported relative to the cylinder block 24, and is provided as an elastic member that generates biasing force for biasing the plurality of pistons 25 toward the swash plate 26. In the present embodiment, the spring 29*b* is provided as a coil spring, and is installed in a compressed state. The rotational shaft 22 is disposed inside the spring 29*b* serving as the coil spring in the state of passing therethrough. Also, the spring 29*b* is supported relative to the cylinder block 24 via the pedestal portion 29*a* held by the cylinder block 24.

The retainer 29*c* is attached to the spring 29*b* at an end portion of the spring 29*b* on the side opposite the cylinder block 24. This retainer 29*c* is provided as a cup-shaped member that is provided, at the center, with a through hole in which the rotational shaft 22 is disposed in a state of passing therethrough. Also, the retainer 29*c* is attached to the end portion of the spring 29*b* in a state in which the end portion of the spring 29*b* inserted inside the retainer 29*c* is abutted against the peripheral edge portion the above-described through hole. Further, a curved surface 29*e* that is formed so as to be tapered, with its outer dimension decreasing toward the tip, is provided on the outer surface of the retainer 29*c*.

The piston biasing plate 29*d* is provided as a planar member that transmits the biasing force from the spring 29*b* to bias the plurality of pistons 25 toward the swash plate 26. Further, a through hole is provided at the center of the piston biasing plate 29*d*, and the piston biasing plate 29*d* is held in the through hole at the center so as to be pivotable relative to the retainer 29*c*. Note that a curved surface 29*f* capable of sliding against the outer curved surface 29*e* of the retainer 29*c* is formed on the inner circumference of the through hole at the center of the piston biasing plate 29*d*. That is, the piston biasing plate 29*d* is installed so as to be pivotable relative to the retainer 29*c* by sliding, with the curved surface 29*f* on the inner circumference of the through hole at the center, against the outer curved surface 29*e* of the retainer 29*c*. Further, the curved surface 29*f* on the inner circumference of the through hole at the center of the piston biasing plate 29*d* is formed as the curved surface 29*f* that is tapered toward the swash plate 26. Thereby, in the curved surface 29*e* that is tapered toward the tip on the outer side thereof, the retainer 29*c* is abutted against the curved surface 29*f* on the inner circumference of the through hole at the center of the piston biasing plate 29*d*, thus biasing the piston biasing plate 29*d* toward the swash plate 26.

Around the through hole at the center, the piston biasing plate 29*d* is provided with a plurality of holes 29*g* along the circumferential direction of the piston biasing plate 29*d*. Each of the plurality of holes 29*g* is formed so as to pass through the piston biasing plate 29*d*. The holes 29*g* are provided at positions corresponding to the respective pistons 25. Also, each of the plurality of pistons 25 is disposed in a state in which it passes through the hole 29*g* provided in the piston biasing plate 29*d* at the piston shaft portion 25*a*. Further, each piston head portion 25*b* is disposed on the swash plate 26 side relative to the piston biasing plate 29*d*, and each piston shaft portion 25*a* passing through the corresponding hole 29*g* is disposed on the cylinder block 24 side relative to the piston biasing plate 29*d*. Thereby, each of the pistons 25 is installed so as to be able to engage with the piston biasing plate 29*d* at the edge portion of the corresponding hole 29*g* on the side opposite the cylinder block 24 with the corresponding piston head portion 25*b*.

The pivot drive mechanism 30 is provided as a mechanism capable of driving the case 27 in which the swash plate 26 is held via the bearing portion 28 such that the case 27 pivots relative to the housing 23. This pivot drive mechanism 30 includes a pivot biasing spring 30*a*, a spring piston 30*b*, and a hydraulic piston 30*c*.

The pivot biasing spring 30*a* is provided as a coil spring that biases the pivot end portion 27*d* of the case 27. Also, the pivot biasing spring 30*a* is installed such that one end thereof is supported inside the disk portion 31*b* of the first housing member 31 and the pivot end portion 27*d* is biased at the other end via the spring piston 30*b*.

The spring piston 30*b* is provided as a member that transmits the biasing force of the pivot biasing spring 30*a* to bias the pivot end portion 27*d* of the case 27. Alto, the spring piston 30*b* is provided as a cup-shaped member, and is attached to the pivot biasing spring 30*a* so as to cover the other end of the pivot biasing spring 30*a*. Further, the spring piston 30*b* is installed inside the first housing member 31 so as to be able to reciprocate in a direction parallel to the center axis C1 of the rotational shaft 22. Further, the spring piston 30*b* is abutted against the curved surface at the tip portion of the pivot end portion 27*d* of the case 27 on the side opposite the side on which it covers the pivot biasing spring 30*a*.

In the tubular portion 31*a* of the first housing member 31, a pressure chamber 30*d* is defined in which pressure oil is introduced that allows the pivot end portion 27*d* of the case 27 to be biased by the hydraulic piston 30*c* toward the opposite direction from the direction in which the pivot biasing spring 30*a* is biased, against the biasing force of the pivot biasing spring 30*a*. Furthermore, the first housing member 31 is provided with an oil path that is in communication with the interior of the pressure chamber 30*d*. Then, this oil path is in communication with the supply path 101*a* via a valve mechanism, which is not shown.

The hydraulic piston 30*c* is installed slidably against the inner wall of the pressure chamber 30*d*, and is supported so as to be freely reciprocate relative to the pressure chamber 30*d*. Also, the end portion of the hydraulic piston 30*c* that protrudes from the pressure chamber 30*d* is abutted against the curved surface at the tip portion of the pivot end portion 27*d* of the case 27. The end of the hydraulic piston 30*c* is abutted against the tip portion of the pivot end portion 27*d* on the side opposite the side on which the spring piston 30*b* is abutted against (the opposite side in a direction parallel to the center axis C1 of the rotational shaft 22).

The above-described valve mechanism provided between the oil path in communication with the interior of the pressure chamber 30*d* and the supply path 101*a* is configured to control the pivot of the swash plate 26 by achieving a balance between the load generated via the hydraulic piston 30*c* by the pressure oil from the supply path 101*a* and the load generated from the pivot biasing spring 30*a*, thus adjusting the discharge amount of the hydraulic pump 1.

As a result of the pressure oil whose pressure is controlled by the above-described valve mechanism being introduced into the pressure chamber 30*d*, the hydraulic piston 30*c* biases the pivot end portion 27*d* of the case 27 against the biasing force of the pivot biasing spring 30*a*. This achieves a state in which the swash plate 26 is inclined relative to the rotational shaft 22 at an inclination angle that has been adjusted by the operation of the above-described valve mechanism. That is, the case 27 pivots about the pivot shaft portions (27*b*, 27*c*), and stops at an inclination angle that has been adjusted by the operation of the above-described valve mechanism. Thereby, the inclination angle of the swash plate 26 is controlled such that the inclination angle of the swash plate 26, which is held relative to the case 27 via the bearing portion 28, relative to the center axis C1 of the rotation centerline C2 is a inclination angle that has been adjusted by the operation of the above-described valve mechanism.

Next, the operation of the hydraulic pump 1 will be described. The operation of the hydraulic pump 1 is started by operating the electric motor 19. Note that in a state before the start of the electric motor 19, the piston biasing mechanism 29 maintains a state in which the plurality of pistons 25 are abutted against and in contact with the swash plate 26. That is, the pistons 25 are biased toward the swash plate 26 via the retainer 29*c* and the piston biasing plate 29 by the biasing force of the spring 29*d*. Then, a state in which the curved surface 25*c* of each of the piston head portions 25*b* is abutted against the end face 26*c* of the planar part 26*a* of the swash plate 26 is maintained.

Upon start of the operation of the electric motor 19, the rotational shaft 22 rotates about the center axis C1, and the cylinder block 24 rotates with the rotational shaft 22. Upon rotation of the cylinder block 24, the plurality of pistons 25 supported by the cylinder block 24 also rotate around the rotational shaft 22 about the center axis C1.

In the above-described state, the piston head portion 25*b* of each of the pistons 25 is abutted against the end face 26*c* of the swash plate 26, and rotates around the rotational shaft 22 while being abutted against the end face 26*c* at substantially the same position. Since the plurality of pistons 25 are pressed against the swash plate 26, the swash plate 26 is driven by the frictional force acting from the piston head portions 25*b*, and rotates about the rotation centerline C2 with the pistons 25. That is, the swash plate 26, which is rotatably held relative to the case 27 via the bearing portion 28, rotates within the case 27 about the rotation centerline C2.

In the above-described state, when the case 27 has an inclined angle relative to the center axis C1, the swash plate 26 rotates about the rotation centerline C2 obliquely inclined relative to the center axis C1. Consequently, while the rotational shaft 22 makes one rotation about the center axis C1, the pistons 25 move by a stroke of one reciprocation cycle in the respective cylinder chambers 24*a*. Then, as a result of the pistons 25 reciprocating in the respective cylinder chambers 24*a* with the rotation of the rotational shaft 22, the pressure of the oil sucked into the cylinder chambers 24*a* is raised and the oil is thereafter discharged.

Note that when a piston 25 is displaced in a direction protruding from the corresponding cylinder chamber 24*a* as a result of rotation of the cylinder block 24 rotating with the rotational shaft 22, oil is sucked into that cylinder chamber 24*a* via the suction port 35*a*, the suction oil path 35*b*, and the suction communication path 35*c*. On the other hand, when a piston 25 is displaced in a direction returning to the corresponding cylinder chamber 24*a* as a result of rotation of the cylinder block 24, the pressure oil is discharged from that cylinder chamber 24*a* as the oil whose pressure has been raised, and the pressure oil is discharged to the outside via the discharge communication path 36*c*, the discharge oil path 36*b*, and the discharge port 36*a*.

Note that when the cylinder block 24 rotates, the piston head portions 25*b* of the pistons 25 rotate around the rotational shaft 22 while they are abutted against the end face 26*c* of the swash plate 26 at substantially the same positions, as described above. Accordingly, while the cylinder block 24 rotates around the rotational shaft 22, the pistons 25 relatively rotate and slide against the inner walls of the cylinder chambers 24*a* in the circumferential direction in the respective cylinder chambers 24*a*.

Next, a hydraulic system 10 including the above-described hydraulic pump 1 will be described. The hydraulic system 10 shown in FIG. 1 includes the above-described hydraulic pump 1, flight controller 2, electric motor 19, driver 20, pressure sensor 21, and so forth.

The flight controller 2 is provided as a superordinate computer of the actuator controllers (15*a*, 15*b*), and is configured as a controller that commands operation of the moving surface 100 and controls operation of the hydraulic pump 1. Note that the flight controller 2 includes, for example, a central processing unit (CPU), a memory, an interface, and so forth, which are not shown.

In the hydraulic system 10, the operational status of the electric motor 19 is controlled by the driver 20 based on a command signal from the flight controller 2. Furthermore, as described above, the pivot drive mechanism 30 is operated and thereby the inclination angle of the swash plate 26 of the hydraulic pump 1 is controlled. Also, a cylinder stroke is adjusted in which the pistons 25 are displaced within the respective cylinder chambers 24*a* while the rotational shaft 22 makes one rotation. Thereby, the pressure of the pressure oil discharged from the hydraulic pump 1 is controlled. Thus, the hydraulic pump 1 is configured as a variable displacement hydraulic pump.

Further, the flight controller 2 is configured to be able to receive a discharge pressure signal for the value of the pressure, detected by the pressure sensor 21, of the pressure oil discharged from the hydraulic pump 1. Also, the flight controller 2 is configured to be able to monitor the operating state of the hydraulic pump 1 and detect an abnormality of the operating state of the hydraulic pump 1, based on the above-described discharge pressure signal. For example, the flight controller 2 determines whether the pressure of the pressure oil discharged from the hydraulic pump 1 is greater than or equal to a predetermined threshold value, base on the above-described discharge pressure signal.

If it is determined that the pressure of the pressure oil discharged from the hydraulic pump 1 is less than a predetermined threshold value, the flight controller 2 determines that the predetermined discharge pressure is not secured in the hydraulic pump 1 and thus an abnormality has occurred. If it is determined that an abnormality has occurred in the operating state of the hydraulic pump 1, the flight controller 2 issues a warning to provide a notification to a manager that manages the operation of the hydraulic system 10. This warning is displayed, for example, on an operation monitoring monitor that is checked by the manager. In the present embodiment, the warning is displayed, for example, on an operation monitoring monitor that is checked by a manager serving as a pilot of an aircraft.

As described thus far, with the hydraulic pump 1, when the rotational shaft 22 is rotationally driven as a result of the torque from the electric motor 19 being input, the cylinder block 24 rotates with the rotational shaft 22, and the pistons 25 rotate around the rotational shaft 22 with the cylinder block 24. Meanwhile, the swash plate 26 is rotatably held via the bearing portion 28 relative to the case 27 that is pivotably supported relative to the housing 23. Then, with the rotation of the pistons 25 around the rotational shaft 22, the swash plate 26 with which the end portions of the pistons 25 (the piston head portions 25*b*) come into contact rotates about the rotation centerline C2 that is obliquely inclined relative to the rotational shaft 22. Thereby, the pistons 25 reciprocate in the respective cylinder chambers 24*a* as a result of rotation of the rotational shaft 22, whereby the pressure of the oil sucked into the cylinder chambers 24*a* is raised and thereafter the oil is discharged.

As described above, with the hydraulic pump 1, the swash plate 26 rotatably held by the case 27 via the bearing portion 28 rotates with the cylinder block 24 and the pistons 25. Accordingly, with the hydraulic pump 1, any shoe structure is not provided between the end portions of the pistons 25 (piston head portions 25*b*) and the swash plate 26, and therefore a reduction in efficiency as in the case of hydraulic pumps of the related art can be suppressed. That is, the hydraulic pump 1 does not suffer from a reduction in efficiency resulting from an energy loss caused by friction between a shoe and the swash plate, and moreover, it does not suffer from a reduction in efficiency resulting from internal oil leakage caused by part of the oil inside the cylinder chambers being supplied between a shoe and the swash plate as lubricating oil. Therefore, with the hydraulic pump 1, a shoeless structure different from conventional swash plate type hydraulic pumps can be realized, which makes it possible to suppress a reduction in efficiency caused by friction and internal oil leakage, thus increasing the efficiency. Furthermore, as a result of increasing the efficiency of the hydraulic pump 1, it is also possible to reduce the heat generation during operation of the hydraulic pump 1.

Accordingly, with the present embodiment, it is possible to provide a swash plate type hydraulic pump 1 that can suppress a reduction in efficiency caused by friction and internal oil leakage, thus increasing the efficiency.

Furthermore, with the hydraulic pump 1, in the pistons 25 and the swash plate 26 that come into contact with each other, the contacting end face 26*c* of the swash plate 26 is flattened, and the curved surface 25*c* constituting part of a spherical surface is formed on the contacting end portion of the piston 25. Accordingly, the swash plate 26 rotatably held relative to the case 27 via the bearing portion 28 can be smoothly rotated with the cylinder block 24 and the pistons 25. Therefore, it is possible to achieve a further improvement in efficiency.

With the hydraulic pump 1, the rolling elements 28*c* of the bearing portion 28 that rotatably supports the swash plate 26 relative to the case 27 are provided in a ball shape, and therefore, the swash plate 26 can be further smoothly rotated with the cylinder block 24 and the pistons 25. Therefore, it is possible to achieve a further improvement in efficiency. Further, since the rolling elements 28*c* are provided in a ball shape, it is possible to reduce the size of the bearing portion 28, as compared to the cases where roller-shaped rolling elements are provided. This makes it possible to reduce the size of the hydraulic pump 1.

With the hydraulic pump 1, the rolling elements 28*c* of the bearing portion 28*a* are formed of a ceramic material, and it is therefore possible to reduce the contact pressure generated between the rolling elements 28*c* and each of the inner ring 28*a* and the outer ring 28*b* in the bearing portion 28, thus improving the pressure resistance of the bearing portion 28. This makes it possible to easily provide a configuration adapted to higher pressure for the swash plate type hydraulic pump 1 whose efficiency has been increased by suppressing a reduction in efficiency caused by friction and internal oil leakage.

With the hydraulic pump 1, in the bearing portion 28, the inner ring 28*a* is fixed to the swash plate 26 and the outer ring 28*b* is fixed to the case 27. Accordingly, the bearing portion 28 that rotatably holds the swash plate 26 relative to the case 27 pivotably supported relative to the housing 23 can be realized with a simple structure in a compact manner.

With the hydraulic pump 1, the inner ring 28*a* of the bearing portion 28 is fixed to the outer circumference of the tubular part 26*b* provided in the swash plate 26, and therefore, the bearing portion 28 can be easily replaced at the time of maintenance. This makes it possible to achieve further improvement in the ease of maintenance for the swash plate type hydraulic pump 1 whose efficiency has been increased by suppressing a reduction in efficiency caused by friction and internal oil leakage.

With the hydraulic pump 1, during initial actuation in which the operation of the initial hydraulic pump 1 is started, the pistons 25 are biased toward the swash plate 26 by the biasing force of the spring 29*b* of the piston biasing mechanism 29. Accordingly, a state in which the end portions of the pistons 25 (piston head portions 25*b*) are in contact with the swash plate 26 is maintained during initial actuation of the hydraulic pump 1, and thus a stable starting characteristic is ensured.

With the hydraulic pump 1, the piston biasing mechanism 29 that can ensure a stable starting characteristic during initial actuation of the hydraulic pump 1 can be constructed in a compact manner with a simple structure including the spring 29*b*, the retainer 29*c* attached to the end portion of the spring 29*b*, and the piston biasing plate 29*d* that is pivotably held by the retainer 29*c* and is engaged with the pistons 25.

With the hydraulic pump 1, the surface of the pistons 25 and the end face 26*c* of the planar part 26*a* of the swash plate 26 are subjected to a coating treatment for providing a diamond like carbon coating, and a coating of diamond like carbon is formed thereon. That is, a coating of diamond like carbon, which is hard and has excellent wear resistance, self-lubricating property, and seizure resistance, is formed on the portions of pistons 25 and the swash plate 26 that come into contact with each other. Therefore, even if an abnormality such as prying or jamming of the bearing portion 28 occurs, the piston head portions 25*b* of the pistons

25 slide against the end face 26*c* of the swash plate 26, thus making it possible to continue the operation of the hydraulic pump 1 for a short period of time. Accordingly, even at the time of occurrence of an abnormality of the bearing portion 28, it is possible to prevent the hydraulic pump 1 from becoming instantly inoperable.

Although an embodiment of the present invention has been described thus far, the present invention is not limited to the embodiment described above, and various modifications may be made within the scope recited in the claims. For example, the following modifications are possible.

(1) Although the above-described embodiment was described taking, as an example, a backup hydraulic pump installed in an aircraft, this need not be the case. The present invention can be widely applied to general swash plate type hydraulic pumps. That is, the present invention can be widely used as hydraulic pumps other than those for use as backup hydraulic pumps installed in aircrafts, hydraulic pumps installed in various vehicles, or hydraulic pumps for supplying pressure oil to various hydraulically operated devices.

(2) The shapes of the pistons and the swash plate are not limited to those illustrated in the above-described embodiment, and various modifications may be made. Also, the configuration of the bearing portion that rotatably holds the swash plate relative to the case is not limited to the shapes described in the above embodiment, and various modifications may be made. Although the above-described embodiment was described taking, as an example, a configuration in which the inner ring of the bearing portion is provided separately from the swash plate and is fixed to the swash plate, this need not be the case. It is possible to implement a configuration in which the inner ring of the bearing portion is provided integrally with the swash plate.

(3) The configuration of the piston biasing mechanism is not limited to the configurations illustrated in the above-described embodiment, and various modifications may be made. For example, it is possible to implement a configuration in which the spring is directly supported relative to the cylinder block, without providing the pedestal portion. The configurations of the spring, the retainer, and the piston biasing plate of the piston biasing mechanism are also not limited to the configurations illustrated in the above-described embodiment, and various modifications may be made.

(4) The configuration in which the case is pivotably supported relative to the housing is not limited to the configurations illustrated in the above-described embodiment, and various modifications may be made. For example, it is possible to implement a configuration in which the case is pivotably supported relative to the housing via a pivot axis provided separately from the case.

The present invention can be widely applied to a swash plate type hydraulic pump including a swash plate that can be installed obliquely inclined relative to a rotational shaft and a plurality of pistons whose axial displacement is defined by the swash plate and that rotate around the rotational shaft. The present invention is not limited to the above-described embodiment, and all modifications, applications and equivalents thereof that fall within the claims, for which modifications and applications would become apparent by reading and understanding the present specification, are intended to be embraced therein.

What is claimed is:

1. A hydraulic pump having a swash plate that can be installed obliquely inclined relative to a rotational shaft and a plurality of pistons whose axial displacement is defined by the swash plate and that rotate around the rotational shaft, comprising:

the rotational shaft receiving input of torque that is output from an electric motor;

a housing that rotatably supports the rotational shaft;

a cylinder block that is installed inside the housing, is provided with a plurality of cylinder chambers extending parallel to the rotational shaft, and rotates with the rotational shaft;

the pistons being supported relative to the respective cylinder chambers in the cylinder block so as to be slidably displaceable along a direction parallel to the rotational shaft;

the swash plate coming into contact with ends of the pistons and being rotatable around the rotational shaft with the pistons, and being rotatable about a rotation centerline that is obliquely inclined relative to the rotational shaft;

a case that is installed inside the housing and pivotably supported relative to the housing;

a bearing portion that holds the swash plate relative to the case so as to be rotatable about the rotation centerline; and a piston biasing mechanism that is supported relative to the cylinder block and includes a spring that biases the pistons toward the swash plate, wherein the pistons reciprocate in the cylinder chambers with rotation of the rotational shaft, whereby the pressure of oil sucked into the cylinder chambers is raised and thereafter the oil is discharged, wherein the piston biasing mechanism includes:

the spring being supported relative to the cylinder block, directly or via a pedestal portion held by the cylinder block;

a retainer that is attached to the spring at an end portion of the spring on a side opposite the cylinder block; and a planar piston biasing plate that is pivotably held relative to the retainer, and transmits biasing force from the spring to bias the pistons toward the swash plate, and wherein each of the pistons has a piston shaft portion extending from inside the cylinder chamber and passing through a hole provided in the piston biasing plate, and a piston head portion disposed on a swash plate side relative to the piston biasing plate, the piston head portion being larger in diameter than the piston shaft portion having a constant diameter from a first point where the piston shaft portion extends from inside the cylinder chamber up to a second point where the piston shaft portion connects to the piston head portion, the diameter of the piston head portion is larger than the constant diameter of the piston shaft portion between the second point and a third point where the piston head portion has the largest diameter so that the piston head portion of each piston can be engaged with the piston biasing plate on a side opposite the cylinder block.

2. The hydraulic pump according to claim 1, wherein an end face of the swash plate that comes into contact with the pistons is flattened, and a curved surface constituting part of a spherical surface having a predetermined size of radius of curvature is formed on an end portion of each of the pistons that comes into contact with the swash plate.

3. The hydraulic pump according to claim 1,
wherein the bearing portion includes a ball-shaped rolling element.

4. The hydraulic pump according to claim 1,
wherein the bearing portion includes a rolling element formed of a ceramic material.

5. The hydraulic pump according to claim 1,
wherein the bearing portion includes:
an inner ring to which the swash plate is fixed or that is provided integrally with the swash plate;
an outer ring that is fixed to the case; and
a rolling element that rolls between the inner ring and the outer ring.

6. The hydraulic pump according to claim 5,
wherein the swash plate is provided with the tubular part that is formed in a tubular shape, and
the inner ring is formed separately from the swash plate and is fixed to an outer circumference of the tubular part.

* * * * *